US006009569A

United States Patent [19]

Ferrara

[11] Patent Number: 6,009,569

[45] Date of Patent: Jan. 4, 2000

[54] TOILET SEAT HANDLE

[76] Inventor: Rick J. Ferrara, 7337 N. Nichols Rd., Flushing, Mich. 48433

[21] Appl. No.: 09/060,244

[22] Filed: Apr. 14, 1998

[51] Int. Cl.[7] ..... A47K 13/10

[52] U.S. Cl. ..... 4/246.3; 4/237; 4/246.1; 16/115

[58] Field of Search ..... 4/246.1, 246.3, 4/237; 16/115

[56] References Cited

U.S. PATENT DOCUMENTS

| | | | |
|---|---|---|---|
| D. 309,091 | 7/1990 | Shepard | 4/246.1 X |
| 2,236,576 | 4/1941 | Loebner . | |
| 3,191,193 | 6/1965 | Bogenberger . | |
| 3,418,681 | 12/1968 | Szabo | 16/115 |
| 4,129,907 | 12/1978 | Vaughan et al. | 4/237 X |
| 4,951,324 | 8/1990 | Lirette | 4/246.1 |
| 5,086,523 | 2/1992 | DeMot et al. | 4/246.1 |
| 5,341,519 | 8/1994 | Cusenza | 4/246.1 |
| 5,375,267 | 12/1994 | Davis | 4/246.1 |
| 5,384,919 | 1/1995 | Smith | 4/448 |
| 5,459,889 | 10/1995 | Jamison | 4/246.1 X |
| 5,636,410 | 6/1997 | Chou | 16/115 |
| 5,653,319 | 8/1997 | Wang | 16/115 X |

*Primary Examiner*—Henry J. Recla
*Assistant Examiner*—Kathleen J. Prunner
*Attorney, Agent, or Firm*—Kenneth L. Tolar

[57] ABSTRACT

A new and improved toilet seat handle including a housing attached to the lower side of a toilet seat having a handle member slidably received therein. The handle member may be retracted and locked within the housing or quickly ejected therefrom using a spring mechanism in communication with a side mounted lever allowing the handle member to be concealably stored when not in use. The handle member has a pair of elongated parallel slots for receiving the housing mounting screws allowing the handle member to slide relative thereto.

11 Claims, 2 Drawing Sheets

TOILET SEAT HANDLE

BACKGROUND OF THE INVENTION

The present invention relates to a toilet seat handle, and more specifically, a spring loaded toilet seat handle selectively retractable within a housing attached to the lower surface of a toilet seat.

DESCRIPTION OF THE PRIOR ART

When raising or lowering a toilet seat, a person typically does not want to touch the seat, especially when using a public restroom. Toilet seats are often soiled, or at least have bacteria and germs thereon. A myriad of toilet seat handles and lifting devices exist in the prior art which are designed to address this problem. However, conventional toilet seat lifting devices generally protrude outwardly from the toilet seat which is unsightly and poses a potential safety or tripping hazard. Pivotable and rotatable toilet seat handles exist in the prior art; however, such handles may only be pivoted from a horizontal to a vertical position and therefore remain visible. For example, U.S. Pat. No. 5,375,267 issued to Davis discloses a toilet seat lifting device comprising a flat plate attached to the underside of a toilet seat and a tubular handle pivotally attached thereto.

U.S. Pat. No. 5,341,519 issued to Cusenza relates to a sanitary toilet seat handle comprising a tubular, flexible lifting handle received within a bore on the toilet seat.

U.S. Pat. No. 4,951,324 issued to Lirette relates to a toilet seat and lid lifter comprising a pivotally supported handle having a pair of generally parallel outwardly extending forward and rearward rod like structures. The configuration enables a person to engage one of the rod like structures with a knee thus elevating the rearward structure allowing it to be lifted with a hand.

U.S. Pat. No. 3,191,193 issued to Bogenberger relates to a toilet seat attachment comprising a handle and a deodorant dispenser integral therewith.

U.S. Pat. No. 2,236,576 issued to Loebner relates to a toilet seat handle rotatably mounted on a toilet seat.

U.S. Pat. No. Des. 309,091 issued to Shepard relates to a design for a toilet seat handle resembling a human hand which is pivotally attached to a toilet seat.

The above described toilet seat handles have several disadvantages. The pivotable or rotatable handles may only be moved between a vertical and horizontal position. In either position, however, the handles are visible presenting the problems described above. Furthermore, the externally stored devices are more likely to be broken or damaged. The present invention relates to a toilet seat handle that may be completely retracted within a housing attached to the lower surface of a toilet seat so that the entire device is completely concealed when not in use. In addition, the device includes a locking, spring loaded ejection mechanism allowing a user to quickly and conveniently release the handle from the housing by depressing a lever.

SUMMARY OF THE INVENTION

The present invention relates to a toilet seat handle which overcomes the above enumerated disadvantages of the prior art. The device comprises a hollow, substantially rectangular housing having four peripheral edges and an interior chamber. The housing is attached to the lower surface of a toilet seat. A peripheral edge of the housing adjacent the outer edge of the toilet seat is open and is in communication with the interior chamber. Protruding from the open edge is a substantially rectangular handle member having an upper surface, a lower surface and four peripheral edges therebetween. Extending from the lower surface to the upper surface are a pair of elongated, parallel slots. The slots receive mounting screws that attach the housing to the toilet seat providing guides for the handle as it slides into and out of the housing. A peripheral edge of the handle engages a hair pin spring within the housing to bias the handle towards the open edge of the housing. A lateral peripheral edge of the handle has a notch thereon for selectively receiving a spring biased lever member protruding from the housing to lock the handle member therewithin when in a retracted position. Accordingly, to access the handle, a user may depress the lever member displacing it from the notch allowing the hair pin spring to push the handle out of the open edge of the housing. It is therefore an object of the present invention to provide a toilet seat handle which may be quickly and conveniently stored beneath a toilet seat.

It is yet another object of the present invention to provide a toilet seat handle having a spring mechanism for locking the handle in a retracted position or automatically releasing it therefrom.

It is yet another object of the present invention to provide a toilet seat handle that is easy to use and inexpensive to manufacture. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
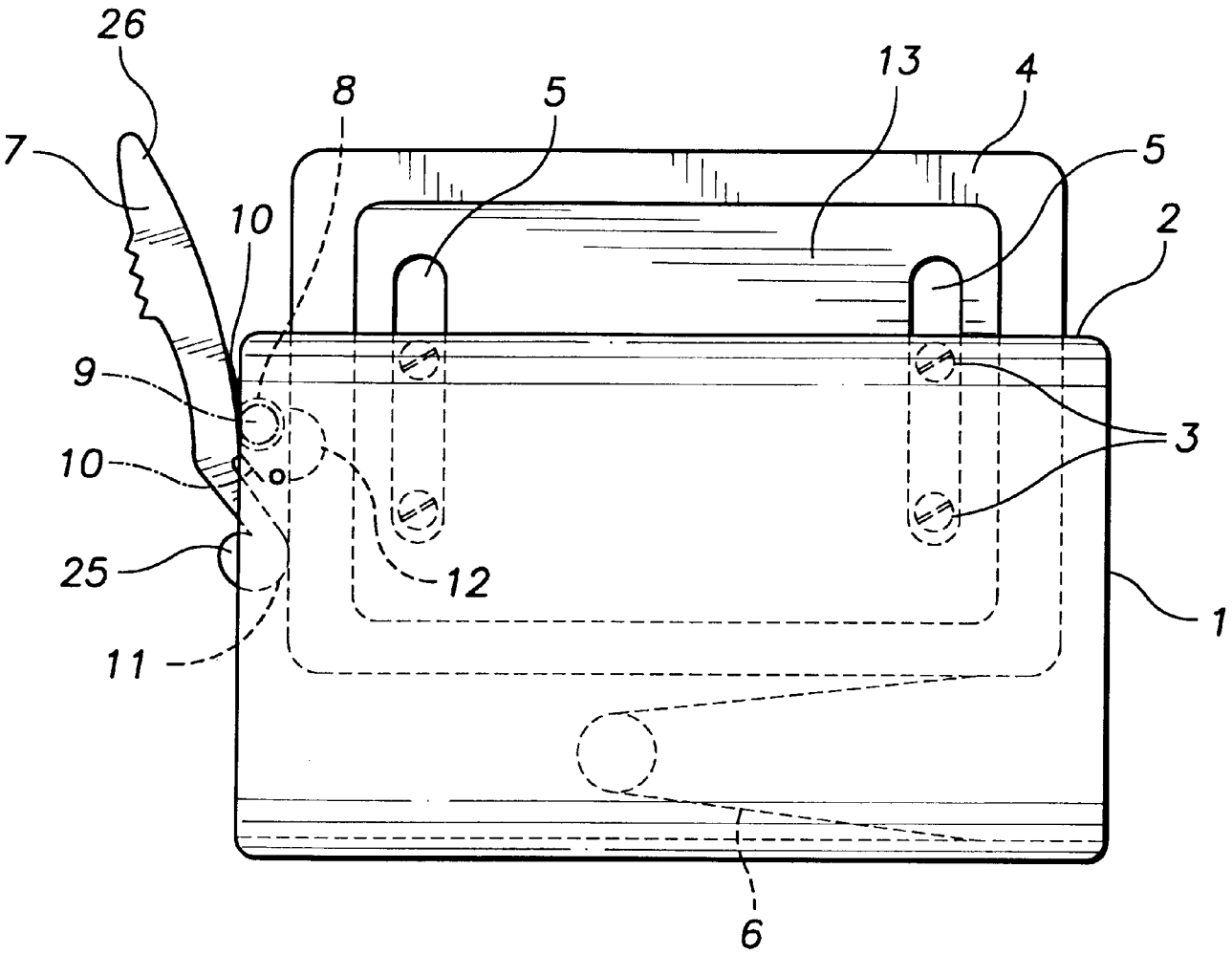
FIG. 1 depicts the inventive device.
Figure 2:
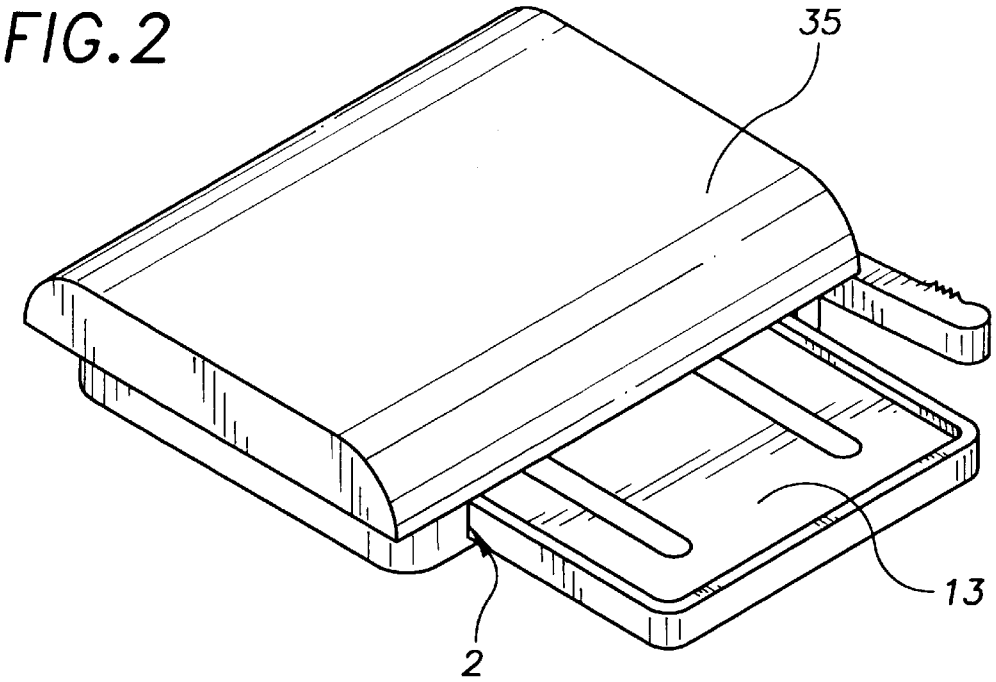
FIG. 2 is a perspective view of the device attached to a toilet seat.
Figure 3:
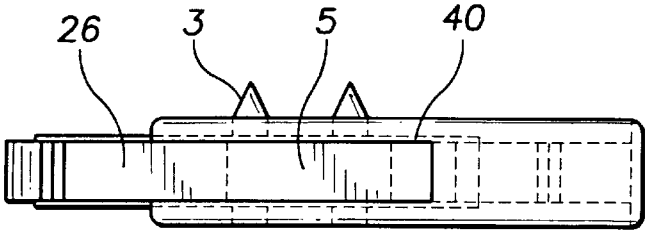
FIG. 3 is a side view of the device depicting the lever extending from the housing.

Referring now to FIG. 1, the present invention relates to a retractable toilet seat handle comprising a substantially rectangular, hollow housing 1 having an interior chamber, planar upper and lower surfaces with two lateral and two longitudinal sides therebetween. A first longitudinal peripheral side is open 2 and is in communication with the housing interior chamber. The housing is attached to the lower surface of a toilet seat 35 using a plurality of screws 3 each preferably received with a bore on the upper surface vertically aligned with a bore on the bottom surface. The housing is secured such that its open side is immediately adjacent a peripheral edge of the toilet seat.

The device further includes a handle member 4 having a pair of opposing planar surfaces with two longitudinal and two lateral peripheral edges therebetween. The handle member 4 is slidably received within the housing interior chamber with a longitudinal edge protruding from the open edge of the housing. The handle member 4 has a pair of parallel, elongated slots 5 extending from the first planar surface to the second, each for receiving one or more housing attachment screws. Accordingly, the handle member may freely slide in and out of the housing without being obstructed by the screws. The screws also function as guides for the handle member as it slides into and out of the housing. Preferably, each planar surface has a recessed portion 13 which may be grasped by a user.

Received within the housing interior chamber, adjacent its second longitudinal side is a hair pin spring member 6 for engaging a second longitudinal edge of the handle member. As the handle member is slid into the housing chamber, the spring biases the handle member toward the open side of the housing. The hair pin spring member is of the type generally known in the prior art and includes a ring portion and a pair of opposed arms extending therefrom. The arms are biased in opposite directions such that, when compressed, they will urge the handle member towards the housing open side.

Protruding from a second opening 40 on a lateral side of the housing, proximal its open side 2 is a lever 26 having an arm portion 7 with substantially J-shaped portion 25 extending therefrom. Between the J-shaped portion and the arm portion is an integral collar 8 rotatably received within which is a pivot 9 mounted within the interior of the housing. Surrounding the pivot 9 and protruding from the collar is a cincture type spring 10 for biasing the arm portion outwardly from the housing. A lateral edge of the handle member adjacent the lever has an arcuate notch 12 thereon dimensioned to selectively receive the curvature 11 on the J-shaped portion to lock the handle member in a retracted position.

To use the above described device, a user pivots the arm portion 7 of the lever inwardly toward the housing against the bias of the cincture spring 10 to unseat the curvature 11 from the handle notch 12 allowing the hair pin spring to eject the handle member through the housing open side. Accordingly, the handle member may be conveniently slid back into the housing against the bias of the hair pin spring 6 until the curvature reseats within the notch. The handle will then be completely retracted within the housing underneath the toilet seat where it will not be visible.

The present invention is not to be limited to the exact details of construction enumerated above. The housing, lever and handle are preferably constructed with plastic though any other material will suffice. The springs are preferably manufactured with stainless steel or a similar corrosion resistant material. Four attachment screws are shown. Although, as will be readily apparent to those skilled in the art, any number of two or more may be used. Furthermore, other suitable attachment means may be used such as bolts, adhesives and similar items.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A toilet seat handle comprising:

a substantially hollow housing having upper and lower surfaces and an open side in communication with a hollow interior, said housing upper surface adapted to be secured to the lower surface of a toilet seat;

a spring biased handle member slidably received within the hollow interior of said housing, said handle member being selectively extendable from and retractable within the open side of said housing and being spring biased toward said open side.

2. A toilet seat handle according to claim 1 wherein said handle member further comprises:

an upper surface, a lower surface and at least one side edge, said side edge having an arcuate notch thereon.

3. A toilet seat handle according to claim 2 wherein said housing further includes a side having an opening therein.

4. A toilet seat handle according to claim 3 further comprising a spring biased pivotable lever extending from the opening on the side of said housing, said lever having a distal end dimensioned to tightly seat within said arcuate notch on said handle member whereby said lever may be pivoted to unseat said distal end to eject said spring biased handle member through the open side of said housing.

5. A toilet seat handle according to claim 4 wherein said lever further comprises a collar integral therewith.

6. A toilet seat handle according to claim 5 further comprising a pivot member mounted within the housing interior and received within said collar allowing said lever to pivot relative thereto.

7. A toilet seat handle according to claim 6 wherein said lever is biased using a cincture type spring.

8. A toilet seat handle according to claim 2 wherein said housing is secured to the lower surface of said toilet seat with a plurality of attachment means.

9. A toilet seat handle according to claim 8 wherein said handle member includes a plurality of slots extending from the upper surface to the lower surface, each slot slidably receiving the attachment means allowing said handle member to slide relative thereto.

10. A toilet seat handle according to claim 2 wherein said handle member further comprises a recessed portion on both said upper and lower surfaces for receiving a user's fingers.

11. A toilet seat handle according to claim 1 wherein said handle member engages a hair pin spring received within said housing interior to bias said handle member towards the open side of said housing.

* * * * *